US009225081B2

(12) United States Patent
Schrader

(10) Patent No.: US 9,225,081 B2
(45) Date of Patent: Dec. 29, 2015

(54) CLAMPING UNIT OF AN ELECTRICAL CONNECTION TERMINAL

(75) Inventor: Andreas Schrader, Delbrueck (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 17 days.

(21) Appl. No.: 14/130,500

(22) PCT Filed: Jul. 4, 2012

(86) PCT No.: PCT/EP2012/063022

§ 371 (c)(1),
(2), (4) Date: Jan. 2, 2014

(87) PCT Pub. No.: WO2013/004738

PCT Pub. Date: Jan. 10, 2013

(65) Prior Publication Data

US 2014/0148067 A1 May 29, 2014

(30) Foreign Application Priority Data

Jul. 4, 2011 (DE) ..... 10 2011 051 536

(51) Int. Cl.
*H01R 4/48* (2006.01)

(52) U.S. Cl.
CPC ..... *H01R 4/48* (2013.01); *H01R 4/4836* (2013.01)

(58) Field of Classification Search
CPC ..... H01R 4/4836
USPC ..... 439/441, 834, 828
See application file for complete search history.

(56) References Cited

U.S. PATENT DOCUMENTS

| | | | | |
|---|---|---|---|---|
| 2009/0035998 | A1 | 2/2009 | Schrader | |
| 2010/0173531 | A1 | 7/2010 | Holste | |
| 2011/0217882 | A1* | 9/2011 | Gassauer | H01R 13/15 439/729 |

FOREIGN PATENT DOCUMENTS

| | | | |
|---|---|---|---|
| DE | 2005923 | A1 | 8/1971 |
| DE | 2225591 | A1 | 12/1973 |
| DE | 2344404 | A1 | 3/1975 |
| DE | 2440825 | A1 | 3/1976 |
| DE | 8136054 | U1 | 4/1982 |
| DE | 10053035 | A1 | 5/2002 |
| DE | 20210105 | U1 | 10/2002 |
| DE | 20312861 | U1 | 10/2003 |
| DE | 102006014646 | A1 | 10/2007 |
| DE | 102007036295 | A1 | 2/2009 |
| DE | 102008049236 | B3 | 6/2010 |
| DE | 102010010262 | A1 | 9/2011 |
| EP | 1168505 | A2 | 1/2002 |
| EP | 1204164 | A1 | 5/2002 |
| JP | 08298148 | A | 11/1996 |

* cited by examiner

*Primary Examiner* — Abdullah Riyami
*Assistant Examiner* — Justin Kratt
(74) *Attorney, Agent, or Firm* — Leydig, Voit & Mayer, Ltd.

(57) ABSTRACT

A clamping unit of an electrical connection terminal includes a busbar, a clamping spring for clamping a conductor to the busbar, and a pin contact-making element for making contact with a pin contact. The pin contact-making element has a spring arm which is arranged substantially parallel to the busbar and which is connected to the bus bar with a connecting piece.

5 Claims, 2 Drawing Sheets

CLAMPING UNIT OF AN ELECTRICAL CONNECTION TERMINAL

CROSS-REFERENCE TO PRIOR APPLICATIONS

This application is a U.S. National Phase application under 35 U.S.C. §371 of International Application No. PCT/EP2012/063022, filed on Jul. 4, 2012, and claims benefit to German Patent Application No. DE 10 2011 051 536.4, filed on Jul. 4, 2011. The International Application was published in German on Jan. 10, 2013, as WO 2013/004738 A1 under PCT Article 21(2).

FIELD

The invention relates to a clamping unit of an electrical connection terminal. The invention further relates to an electrical connection terminal comprising a clamping unit of this type.

BACKGROUND

Electrical connection terminals which can be mounted on a pin header having one or more pin contacts may also comprise conductor connection regions which, by means of fastening a screw, can fix a conductor to be connected. However, these pluggable screw terminals have the drawback that rigid conductors cannot be directly connected. In addition, the actuation is more complex and thus the conductor connection time is longer in comparison with a spring-loaded terminal in which the conductor is fixed by a clamping spring instead of a screw. In this regard, connection terminals are known which, in addition to the clamping spring, comprise a tulip connector as a pin-contacting element for contacting the pin contact of the pin header. However, the known connection terminals are disadvantageous in that the clamping spring and the tulip connector are normally arranged one below the other, as described for example in DE 10 2006 014 646 A1, which leads to higher space requirements.

SUMMARY

In an embodiment, the invention provides a clamping unit of an electrical connection terminal. The clamping unit includes: a busbar; a clamping spring configured to clamp a conductor to the busbar; and a pin-contacting element configured to contact a pin contact. The pin-contacting element includes a spring arm which is arranged substantially parallel to the busbar, and the spring arm is connected to the busbar by a connection piece.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
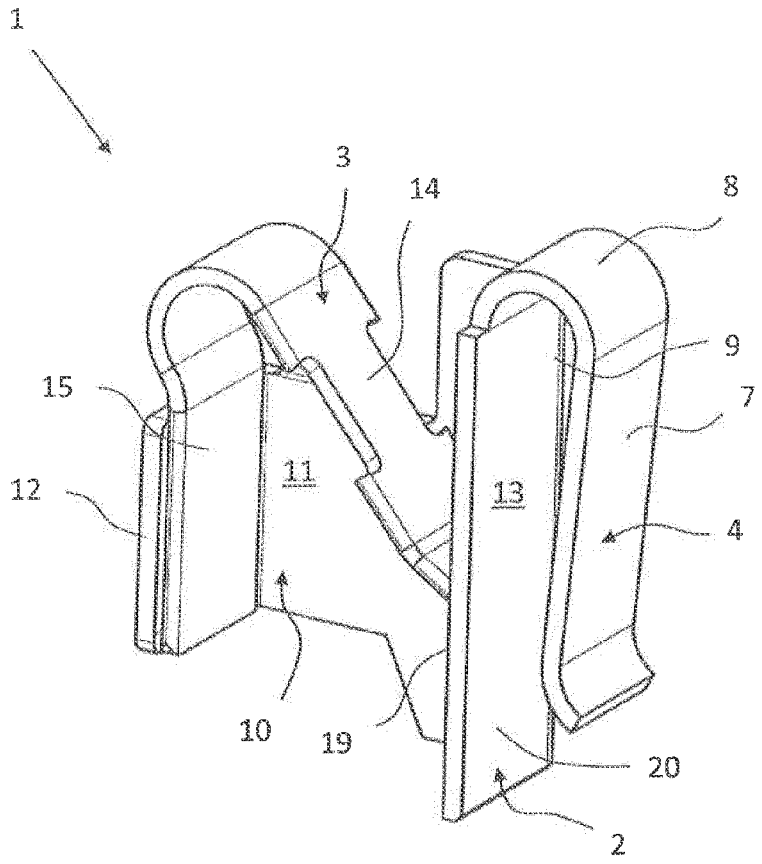
FIG. 1 is a schematic view of a clamping unit according to the invention.

An aspect of the invention provides a solution which allows the size of an electrical connection terminal to be significantly reduced.

In a clamping unit of an electrical connection terminal of the type mentioned in more detail at the outset, the invention provides the electrical connection terminal comprising a busbar, a clamping spring for clamping a conductor to the busbar and a pin-contacting element for contacting a pin contact, wherein the pin-contacting element comprises a spring arm which is arranged substantially parallel to the busbar and which is connected to the busbar by means of a connection piece.

The clamping unit of an electrical connection terminal according to the invention is characterized in that it has much smaller dimensions and is thus smaller in comparison with the known clamping units used in a connection terminal which have a clamping spring and a pin-contacting element. In the connection terminal according to the invention, a conductor connected in the connection terminal can be positioned parallel to an inserted pin contact, the configuration according to the invention of the connection terminal allowing both the inserted conductor and the pin contact to rest on the same busbar so as to form a contact. In this case, the inserted conductor is clamped onto a first lateral face of the busbar by means of the clamping spring and the inserted pin contact is clamped onto a second lateral face of the busbar, which is opposite the first lateral face, by means of the spring arm. This makes it possible for the inserted conductor to be positioned directly next to the inserted pin contact, the conductor and the pin contact only being separated by the busbar. In this way, a very short current path from the conductor to the contact pin can be achieved, which causes a reduced voltage drop and at the same time reduces the overall height of the connection terminal. As the spring arm presses the pin contact against the busbar, the pin contact is held clamped by means of the spring arm, which is directly connected to the busbar by means of the connection piece. Here, the clamping unit preferably comprises precisely one spring arm. It is not necessary in this case to provide two or more spring arms. By providing a spring arm which is resiliently movable in relation to the busbar, it is possible to adjust the spacing between the busbar and the spring arm according to requirements. This makes it possible to hold pin contacts of different diameters clamped in the clamping unit, thereby allowing both pin contacts of small diameter and pin contacts of large diameter to be securely contacted in the clamping unit. In order to connect the pin contact, the pin contact can be slid easily into the clearance between the busbar and the spring arm, the spring arm being able to extend depending on the diameter of the pin contact. In the contacted state, i.e. when the pin contact rests on the busbar, the longitudinal lateral face of the pin contact preferably rests on the busbar over the entire length thereof. This creates a particularly long contact surface between the pin contact and the busbar, whereby a long contact line for transmitting current can be formed. This allows for a reliable transmission of current even in the case of low surface pressure, which is produced by the pressure of the spring arm of the pin-contacting element acting on the pin contact. Therefore, since only a relatively small surface pressure is required for reliable contacting due to the configuration of the pin-contacting element having the spring arm, wear of the pin contact, which is caused by the pin contact being frequently inserted and released, can be significantly reduced. The connection terminal is further characterized in that the plugging direction of the contact pin and of the conductor and the operation direction for releasing the conductor are the same.

According to a preferred embodiment of the connection terminal, the connection piece is a flexible joint. The flexible joint allows for an improved spring action of the spring arm in order to achieve a particularly flexible adaptability of the spring arm to the size of the pin contact to be inserted and connected. In this case, the connection piece or the flexible joint is preferably formed of a substantially semi-circular metal strip, which is arranged on a free end of the spring arm and on a free end of the busbar in order to connect the spring arm to the busbar.

It is also preferably provided that the pin-contacting element is formed in one piece with the busbar, such that the pin-contacting element and the busbar are made of the same material. The connection piece and the spring arm are thus preferably also formed from a conductive metal, as is the busbar, whereby higher transferrable current intensities can be achieved.

According to the invention, another advantageous embodiment of the clamping unit provides that the clamping unit comprises a U-shaped contact pocket comprising a first member and a second member which is opposite the first member, the second member forming the busbar. The contact pocket forms a protected receiving space for the clamping spring and at the same time provides a busbar and a pin-contacting element, when the busbar is formed in one piece with the pin-contacting element. As a result, a particularly compact clamping unit, and thus also a particularly compact connection terminal, can be provided. In addition, the number of required components can be reduced and it is possible to arrange the individual components in relation to one another in a fixed frame such that they cannot slip. The clamping pocket is preferably made entirely of a conductive metal and can be positioned in an insulating housing of a connection terminal.

Furthermore, it is preferably provided that the clamping spring comprises a clamping member and a supporting member, the supporting member of the clamping spring resting flush with the first member of the contact pocket. Since the supporting member of the clamping spring rests flush with the first member of the contact pocket, the clamping spring is securely positioned in the contact pocket, such that in particular undesirable slipping of the clamping spring can be prevented. This also allows the clamping force of the clamping spring to be increased.

FIG. 1 shows a clamping unit 1 according to an embodiment of the invention. The clamping unit 1 comprises a busbar 2, a clamping spring 3 for clamping a conductor (not shown here) to the busbar 2 and a pin-contacting element 4 for contacting a pin contact 5 of a pin header 6, as shown in FIG. 2.

The pin-contacting element 4 comprises a spring arm 7 which is arranged substantially parallel to the busbar 2 and is connected to the busbar 2 by means of a connection piece 8. The spring arm 7 is formed of a metal strip, the longitudinal lateral face of which is opposite the longitudinal lateral face of the busbar 2. A receiving space 9 is formed between the spring arm 7 and the busbar 2, into which receiving space the pin contact 5 can be inserted, as shown in FIG. 2. When in a non-use state, i.e. when there is no pin contact 5 inserted, the receiving space 9 is preferably smaller than the diameter of the pin contact 5 to be contacted. When the pin contact 5 is inserted into the receiving space 9, the spring arm 7 is thereby pushed outwards, counter to the resilience and away from the busbar 2, such that the spring arm 7 can apply a clamping force to the pin contact 5. The pin contact 5 inserted into the receiving space 9 is thereby pushed onto the busbar 2 by means of the spring arm 7, such that the pin contact 5 preferably rests flush with the busbar 2 over the entire length of said busbar 2, such that a contact surface which is as large as possible is formed between the pin contact 5 and the busbar 2. The spring arm 7 preferably extends over approximately ⅔ the length of the busbar 2. Furthermore, the spring arm 7 is integrally connected to the busbar 2 by means of the connection piece 8, such that the spring arm 7 and the connection piece 8 are preferably made of the same material (a conductive metal) as the busbar 2. The connection piece 8 is a flexible joint which is formed of a substantially semi-circular curved metal strip and is the same width as the spring arm 7. The connection piece 8 is arranged on a free end of the spring arm 7 and a free end of the busbar 2 so as to connect the spring arm 7 to the busbar 2. The spacing of the spring arm 7 from the busbar 2 can be changed by the connection piece 8 formed as a flexible joint, in that the spring arm 7 is for example moved away from the busbar 2, such that pin contacts 5 of a wide range of different diameters can be securely held in a contacting manner on the busbar 2 by means of the spring arm 7.

The clamping unit 1 further comprises a U-shaped contact pocket 10 which is formed of a conductive metal. The contact pocket 10 is formed of a main plate 11 and a first member 12, which is bent away from the main plate 11 preferably at a right angle, and a second member 13, which is bent away from the main plate 11 preferably at a right angle. The first member 12 is formed opposite the second member 13. In this embodiment, the second member 13 directly forms the busbar 2, such that it is no longer necessary to have another component formed as the busbar 2. The clamping spring 3, which is formed as a member spring and comprises a contact member 14 and a supporting member 15, is arranged in the contact pocket 10 in such a way that the supporting member 15 of the clamping spring 3 rests flush with the first member 12 of the contact pocket 10. The contact pocket 10 forms an interior space which is delimited by the main plate 11, the first member 12 and the second member 13. The clamping spring 3 is arranged within this interior space. By contrast, the pin-contacting element 4 having the spring arm 7 and the connection piece 8 is arranged outside the interior space of the contact pocket 10, the pin-contacting element 4 being directly connected, preferably integrally, to the contact pocket 10 by means of the second member 13 formed as the busbar 2. An inserted conductor is pressed onto the busbar 2 and held clamped by means of the clamping member 14 of the clamping spring 3.

Figure 2:
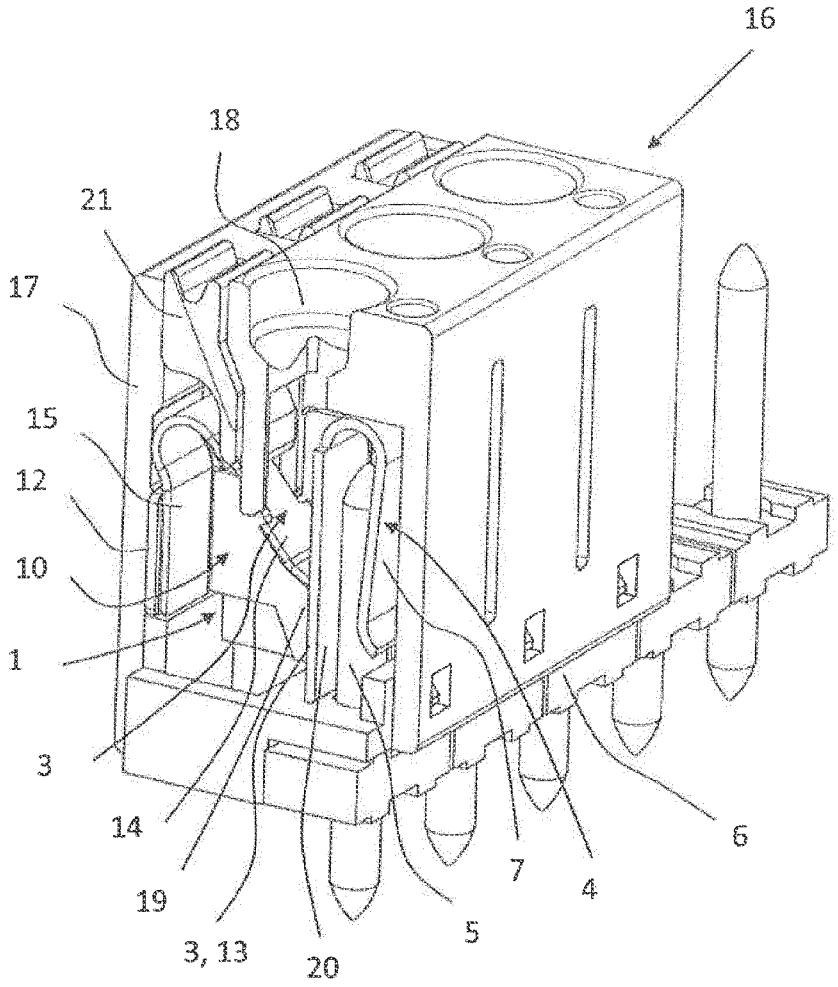
FIG. 2 is a schematic view of an electrical connection terminal according to the invention.

FIG. 2 shows an electrical connection terminal 16 comprising a clamping unit 1 as shown in FIG. 1, the clamping unit 1 being arranged in an insulating housing 17 of the connection terminal 16. Furthermore, FIG. 2 shows a pin header 6 having a plurality of pin contacts 5, the electrical connection terminal 16 having the insulating housing 17 being placed onto the pin header 6 for contacting the pin contact 5, such that each of the pin contacts 5 is held clamped in the receiving space 9 formed between the busbar 2 and the spring arm 7 and such that they contact the busbar 2. A conductor to be clamped is inserted into the clamping unit 1 in the region between the clamping spring 3, in particular the clamping member 14 of the clamping spring 3, and the busbar 2 via a conductor insertion opening 18 formed in the insulating housing 17 and is held clamped on the busbar 2. An inserted conductor is thus positioned parallel to the pin contact 5 within the clamping unit 1, both the inserted conductor and the pin contact 5 resting on one and the same busbar 2 for forming a contact. Here, the inserted conductor is clamped onto a first lateral face 19 of the busbar 2 by means of the clamping spring 3 and the inserted pin contact 5 is held clamped onto a second lateral face 20 of the busbar 2, which is opposite the first lateral face 19, by means of the spring arm 7. This allows the inserted conductor to be positioned directly next to the inserted pin contact 5, the conductor and the pin contact 5 only being separated by the busbar 2. The connection terminal 16 comprises an actuating element 21 in the form of a pusher for releasing the conductor from the clamping unit 1, which pusher can be actuated by a tool and can be pushed in the direction of the supporting member 15 by means of the contact member 14 of the clamping spring 3 so as to release the clamped conductor.

The connection terminal 16 shown in FIG. 2 comprises three units which are formed in the insulating housing 17, each unit comprising a conductor insertion opening 18, an actuating element 12 and a clamping unit 1, such that each unit can connect in a contacting manner each conductor to a pin contact 5 of the pin header 6.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

Clamping unit 1
Busbar 2
Clamping spring 3
Pin-contacting element 4
Pin contact 5
Pin header 6
Spring arm 7
Connection piece 8
Receiving space 9
Contact pocket 10
Main plate 11
First member 12
Second member 13
Clamping member 14
Supporting member 15
Electrical connection terminal 16
Insulating housing 17
Conductor insertion opening 18
First lateral face 19
Second lateral face 20
Actuating element 21

The invention claimed is:

1. A clamping unit of an electrical connection terminal, the clamping unit comprising:
- a busbar;
- a clamping spring configured to clamp a conductor to the busbar; and
- a pin-contacting element configured to contact a pin contact,
- wherein the pin-contacting element comprises a spring arm which is arranged substantially parallel to the busbar,
- wherein the spring arm is connected to the busbar by a connection piece,
- wherein the clamping unit comprises a U-shaped contact pocket comprising
  - a first member, and
  - a second member which is opposite the first member,
  - wherein the second member of the U-shaped contact pocket forms the busbar, and
- wherein the clamping unit comprises
  - a clamping member, and
  - a supporting member,
  - wherein the supporting member of the clamping spring is disposed flush with the first member of the contact pocket.

2. The clamping unit of claim 1, wherein the connection piece is a flexible joint.

3. The clamping unit of claim 1, wherein the pin-contacting element is formed in one piece with the busbar.

4. An electrical connection terminal, comprising:
the clamping unit of claim 1.

5. The clamping unit of claim 2, wherein the pin-contacting element is formed in one piece with the busbar.

* * * * *